US012203152B2

(12) United States Patent
Ma et al.

(10) Patent No.: US 12,203,152 B2
(45) Date of Patent: Jan. 21, 2025

(54) METHOD OF PREPARING BIODEGRADABLE Zn—Mg—Bi ZINC ALLOY

(71) Applicants: Xi'an Jiaotong University, Xi'an (CN); SHAANXI ZINC INDUSTRY CO., LTD., Shangluo (CN)

(72) Inventors: Shengqiang Ma, Xi'an (CN); Ping Lv, Xi'an (CN); Xuebin He, Shangluo (CN); Yimin Gao, Xi'an (CN); Xudong Cui, Shangluo (CN); Jiandong Xing, Xi'an (CN); Xiaoli Meng, Xi'an (CN); Jiankang Zhang, Shangluo (CN)

(73) Assignees: Xi'an Jiaotong University, Xi'an (CN); SHAANXI ZINC INDUSTRY CO., LTD., Shangluo (CN)

( * ) Notice: Subject to any disclaimer, the term of this patent is extended or adjusted under 35 U.S.C. 154(b) by 0 days.

(21) Appl. No.: 18/395,215

(22) Filed: Dec. 22, 2023

(65) Prior Publication Data

US 2024/0295009 A1 Sep. 5, 2024

Related U.S. Application Data

(62) Division of application No. 17/840,871, filed on Jun. 15, 2022, now abandoned.

(30) Foreign Application Priority Data

Dec. 14, 2021 (CN) ..... 202111525807.3

(51) Int. Cl.
*C22C 12/00* (2006.01)
*C22C 1/02* (2006.01)
(Continued)

(52) U.S. Cl.
CPC ..... *C22C 12/00* (2013.01); *C22C 1/02* (2013.01); *C22C 13/00* (2013.01); *C22C 18/00* (2013.01)

(58) Field of Classification Search
None
See application file for complete search history.

(56) References Cited

U.S. PATENT DOCUMENTS

2019/0112682 A1 4/2019 Kohsaka et al.
2019/0144983 A1 5/2019 Pinger et al.

FOREIGN PATENT DOCUMENTS

CN 107982584 A 5/2018
CN 107988528 A 5/2018
CN 109778035 A * 5/2019

OTHER PUBLICATIONS

English language machine translation of CN-109778035-A. Generated Nov. 14, 2024. (Year: 2024).*

(Continued)

*Primary Examiner* — Brian D Walck

(57) ABSTRACT

A method of preparing biodegradable Zn—Mg—Bi zinc alloy includes: melting magnesium under an inert atmosphere to obtain a magnesium melt; adding bismuth particles to the magnesium melt followed by reaction under stirring and heat preservation treatment to obtain a Mg—Bi alloy melt; allowing the Mg—Bi alloy melt to stand in a furnace; subjecting the Mg—Bi alloy melt to refining, slagging-off, casting and demoulding to obtain Mg-50 wt. % Bi alloy ingot; melting zinc to obtain a zinc melt; adding the Mg-50 wt. % Bi alloy ingot and pure magnesium or pure bismuth followed by heating to a preset temperature, stirring and heat preservation to obtain a Zn—Mg—Bi alloy melt; allowing the Zn—Mg—Bi alloy melt to stand in a furnace followed (Continued)

by refining, slagging-off, casting and demoulding to obtain the biodegradable Zn—Mg—Bi zinc alloy.

6 Claims, 2 Drawing Sheets

(51) Int. Cl.
*C22C 13/00* (2006.01)
*C22C 18/00* (2006.01)

(56) References Cited

OTHER PUBLICATIONS

H. R. Bakhsheshi-Rad et al., "Thermal Characteristics, Mechanical Properties, In Vitro Degradation and Cytotoxicity of Novel Biodegradable Zn—Al—Mg and Zn—Al—Mg—xBi Alloys", Acta Metall. Sin. (Engl. Lett.), 2017, 30(3), pp. 201-211.

* cited by examiner

METHOD OF PREPARING BIODEGRADABLE Zn—Mg—Bi ZINC ALLOY

CROSS-REFERENCE TO RELATED APPLICATIONS

This application is a divisional of U.S. patent application Ser. No. 17/840,871, filed Jun. 15, 2022, which claims the benefit of priority from Chinese Patent Application No. 202111525807.3, filed on Dec. 14, 2021. The content of the aforementioned applications, including any intervening amendments thereto, is incorporated herein by reference in its entirety.

TECHNICAL FIELD

This application relates to biodegradable multi-component zinc alloy, and more particularly to a method of preparing biodegradable Zn—Mg—Bi zinc alloy.

BACKGROUND

As a kind of biomaterials with excellent biocompatibility and capable of interacting with living organisms, biomedical materials can be used alone or applied as a complex system to guide the medical treatment, implementation of biological function or diagnosis process. With the rapid development of life science and material science, it is widely expected that the medical devices or implants implanted in the body merely play a temporary or short-term replacement role for rehabilitation, and will be gradually degraded and absorbed by the human body along with the repair of damaged tissues or organs. This therapeutic strategy has excellent biocompatibility, and is free of toxic side effects, adverse biological reactions and harmful stimuli. Consequently, the research and development of biomedical materials has drawn extensive attention.

Extensive researches have been conducted on the development of biodegradable medical materials. Traditional bioimplant materials, such as polymers, cobalt alloys, titanium alloys and medical stainless steel, require to be removed through a secondary operation, which will traumatize the human body. In addition, some implant materials will release harmful ions, which will cause secondary damage to the healed tissue, resulting in some human syndromes. By comparison, biodegradable materials will be gradually degraded after being implanted into the human body, and the degradation products will participate in the in-vivo metabolic activities, and eventually be excreted from the body, without causing toxic and side effects to the body.

Currently, biodegradable metal materials mainly include magnesium alloys and iron alloys. Due to the active chemical properties, the magnesium alloys will experience rapid degradation after the implantation accompanied by large production of evolved hydrogen. In this case, it fails to realize the effective fixation and recovery of damaged organs before the tissue heals. Iron alloys have a slow degradation rate, and they are still required to be removed by a second operation, or left in the body, limiting their application in clinical medicine as an implant material.

In recent years, zinc alloys have been highly-anticipated as a new type of biodegradable metal materials. Zinc is one of the essential elements in the human body, and plays an important role in human metabolism. The electrode potential of zinc is between that of magnesium and iron, such that the corrosion rate is slightly faster than that of iron and slower than that of magnesium. Metal zinc is soft and brittle, while zinc alloys have significantly improved mechanical properties while ensuring a slow degradation rate and good biocompatibility. In consequence, developing biodegradable zinc alloys will significantly promote the application of zinc alloys in the clinical medicine.

Bismuth is a non-essential element for animals and plants, and a trace amount of bismuth is harmless to the human body, such that it is often applied in the field of medicine in the form of compounds, such as contrast agents, potassium bismuth tartrate, salicylates, magma bismuth, bismuth agents, cosmetics, etc. Bismuth is similar to plumbum in many properties, but bismuth, which is a "green metal", is harmless to the human body. With the continuous improvement of people's living standards and increasing attention to green materials, the plumbum has been gradually replaced with bismuth in the material processing. Additionally, the addition of bismuth to the magnesium alloys can promote the bone formation without gas generation, and can form a hexagonal $Mg_3Bi_2$ strengthening phase with outstanding thermodynamic stability, having a brilliant clinical application prospect.

SUMMARY

An objective of this disclosure is to provide a method of preparing a biodegradable Zn—Mg—Bi zinc alloy to overcome the defects of low strength and insufficient performance in the existing zinc alloys.

Technical solutions of this disclosure are described as follows.

In a first aspect, this application provides a method for preparing a biodegradable Zn—Mg—Bi zinc alloy, comprising:

heating magnesium under an inert atmosphere to obtain a magnesium melt; adding bismuth particles to the magnesium melt followed by reaction under stirring and heat preservation treatment to obtain a Mg—Bi alloy melt; allowing the Mg—Bi alloy melt to stand in a furnace; and subjecting the Mg—Bi alloy melt to refining, slagging-off, casting and demoulding to obtain a Mg-50 wt. % Bi alloy ingot; and melting zinc to obtain a zinc melt; adding the Mg-50 wt. % Bi alloy ingot and pure magnesium or the Mg-50 wt. % Bi alloy ingot and pure bismuth to the zinc melt, followed by heating under stirring, and heat preservation to obtain a Zn—Mg—Bi alloy melt; allowing the Zn—Mg—Bi alloy melt to stand in the furnace; and subjecting the Zn—Mg—Bi alloy to refining, slagging off, casting and demoulding to obtain the biodegradable Zn—Mg—Bi zinc alloy.

In an embodiment, the Mg—Bi alloy melt is prepared through steps of:

melting the magnesium at 650-700° C. in argon gas in the presence of a covering agent followed by keeping at 650-700° C. for 60-90 min to obtain the magnesium melt; and adding the bismuth particles to the magnesium melt followed by reaction stirring at 50-80 rpm and 640-660° C. for 20-30 min, and keeping at 640-660° C. for 12-15 min to obtain the Mg—Bi alloy melt.

In an embodiment, in step (1), the casting is performed at 580-610° C.; and the Mg—Bi alloy melt is allowed to stand in the furnace for 3-5 min.

In an embodiment, the Zn—Mg—Bi alloy melt is prepared through steps of:

melting the zinc at 420-500° C. in argon gas for 60-90 min to obtain the zinc melt; adding the Mg-50 wt. % Bi alloy ingot and pure magnesium or pure bismuth to the zinc melt followed by stirring at 50-80 rpm and 640-660° C. for 20-30 min and keeping at 640-660° C. for 12-15 min to obtain the Zn—Mg—Bi alloy melt.

In an embodiment, the Zn—Mg—Bi alloy melt comprises 6-20% by volume of $Mg_3Bi_2$ as main strengthening phase; the $Mg_3Bi_2$ is produced by reaction of magnesium atoms and bismuth atoms; and a weight ratio of bismuth to magnesium in the Zn—Mg—Bi alloy melt is less than or equal to 2.2.

In an embodiment, in step (2), the casting is performed at 510-550° C., and a mold used in the demoulding is preheated to 180-200° C.

Compared with the prior art, this application has the following beneficial effects.

With regard to the preparation method provided herein, a Mg 50 wt. % Bi intermediate alloy is prepared as follows. A magnesium ingot is weighed and completely melted in a silicon carbide crucible to obtain a magnesium melt in an inert atmosphere. Bismuth particles are added to the magnesium melt followed by reaction under stirring and heat preservation to obtain a Mg-50 wt. % Bi intermediate alloy. Further, the Zn—Mg—Bi alloy melt is prepared as follows. A zinc ingot is weighed and completely melted in a silicon carbide crucible to obtain a zinc melt. The Mg-50 wt. % Bi alloy ingot and pure magnesium particles or pure bismuth particles are added to the zinc melt followed by heat preservation and heating under stirring in an inset atmosphere to obtain a Zn—Mg—Bi alloy melt. The Zn—Mg—Bi alloy melt is subjected to refining, slagging-off, casting to obtain the Zn—Mg—Bi zinc alloy. The bismuth is introduced to improve the microstructure and properties of biodegradable zinc alloy, so as to allow the biodegradable zinc alloys to have higher hardness, which brings new ideas to the zinc alloy to be applied in biodegradable materials. Comprehensive information such as composition and structure morphology are obtained by measurement and characterization, which not only proves that the bismuth-containing zinc alloy prepared by the method provided herein significantly enhances the hardness of the zinc alloy, but also reveals the influence of bismuth on the microstructure and properties of the zinc alloy.

In an embodiment, considering that the melting point of pure magnesium is 648.9° C., the pure magnesium is melted at 650 to 700° C. for 60-90 min. The high-purity argon is introduced during the melting process, and a covering agent is added for protection, which not only effectively reduces the oxidation of raw materials, but also refines the melt, thereby improving the purity of the melt reaction.

In an embodiment, in step (1), the casting is performed at 580-610° C., which can not only ensure that the Mg and Bi are sufficiently reacted in the melt, but also prevent the low-melting-point component Bi from being severely burned due to the excessively high temperature. As shown in the Mg—Bi phase diagram, when the bismuth content is 50% by weight, the liquidus is about 560° C., and the casting temperature should be about 50° C. above the liquidus, so as to not only ensure that the diffusion reaction of the Mg and Bi can be fully performed in the melt, but also prevent the low-melting-point component Bi from being severely burned due to the excessively high temperature.

In an embodiment, the determination range of the parameters of the melting process is determined according to the optimal parameters obtained by the measurement process, which not only ensures that the diffusion reaction of magnesium and bismuth in the melt is performed effectively and fast, such that a strengthening phase is formed, but also improves the reaction efficiency and prevents the low-melting-point component from being severely burned. As exhibited in the Zn—Mg phase diagram and the Mg—Bi phase diagram, the magnesium is added to the zinc to form the $Mg_2Zn_{11}$ eutectic phase, and the bismuth is added to form the $Mg_3Bi_2$ phase with magnesium, which is taken as the main strengthening phase. As a result, the objective of the design of the Zn—Mg—Bi zinc alloy provided herein is to further improve the mechanical properties of the zinc alloy by the dual-phase strengthening and toughening.

In an embodiment, Zn—Mg—Bi zinc alloys with different bismuth contents are prepared herein, where a magnesium content is 1.2% by weight, and a bismuth content are respectively 0.5%, 1.0%, 1.5%, 2.0%, 2.5% by weight. The objective is to find out the influence of the increasing bismuth content on the structure and properties of zinc alloy. When the magnesium and the bismuth are subjected to a solid solution strengthening in the zinc matrix, the intragrain strengthening phase is formed, and the strengthening effect of the whole Zn—Mg—Bi zinc alloy is improved. As shown in the Zn—Mg phase diagram, the $Mg_2Zn_{11}$ phase will be formed in the hypoeutectic region when the magnesium content is about 2%. Moreover, as shown in the Mg—Bi phase diagram, a small amount (such as 0.5 wt. %-2.5 wt. %) of Bi is added to form a $Mg_3Bi_2$ strengthening phase with good dispersibility. A weight ratio of Mg to Bi is no more than 2.2, ensuring that 6-20% by volume of the $Mg_3Bi_2$ strengthening phase has the optimal strengthening effect. Additionally, it is illustrated in the researches that Bi has a good effect of grain refinement. The strength and toughness of zinc alloys will be improved through synergistic multiple strengthening and toughening, such as grain refinement, precipitation strengthening and other toughening. The above components are determined based on experiments and phase diagrams. The advantage is that $Mg_2Zn_{11}$ strengthening phase at the grain boundary and the intragrain $Mg_3Bi_2$ phase can be formed at the same time, and the strengthening phases are distributed uniformly, exhibiting an isolated state with controllable shape.

In an embodiment, in step (2), the casting of the biodegradable Zn—Mg—Bi zinc alloy is performed at 510-550° C., and the mold using in the demolding is preheated to 180-200° C. to ensure the optimal demoulding and avoid surface oxidation of the biodegradable zinc alloy.

In a conclusion, the method provided herein obtains a biodegradable Zn—Mg—Bi zinc alloy with higher hardness by preparing the Mg-50 wt. % Bi intermediate alloy, providing a technological support for the zinc alloy to be applied in biodegradable materials.

The technical solutions of the disclosure will be described in detail below with reference to the accompanying drawings and embodiments.

DETAILED DESCRIPTION OF EMBODIMENTS

Figure 1:
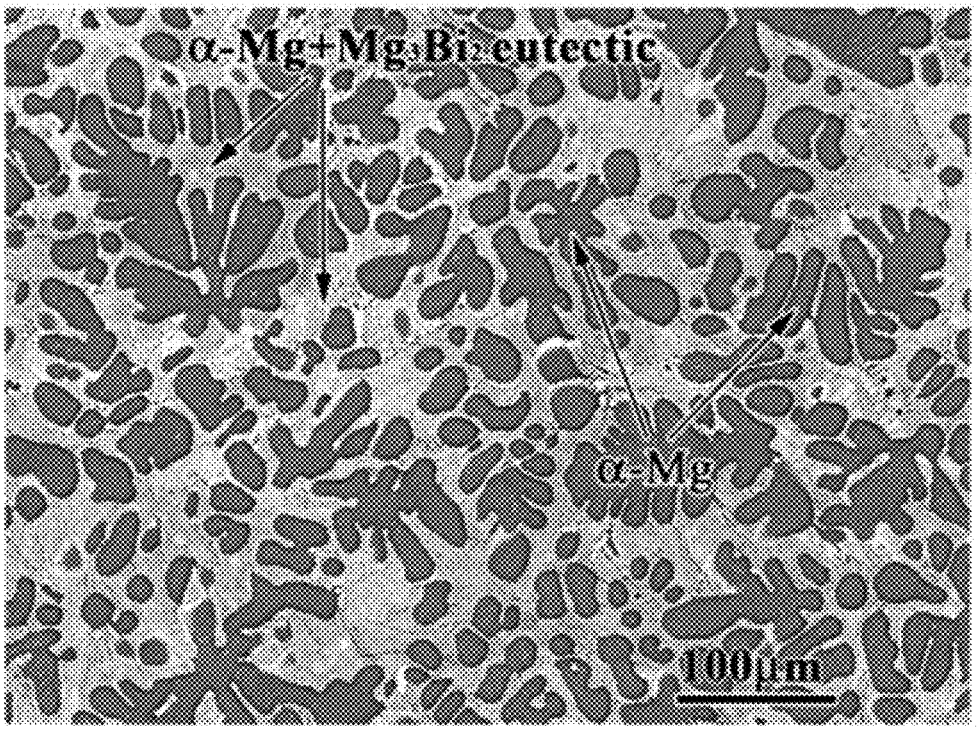
FIG. 1 illustrates a microstructure of a Mg-50 wt. % Bi intermediate alloy.

The technical solutions of this disclosure will be described clearly and completely below. Obviously, described below are merely some embodiments of this disclosure, which are not intended to limit the disclosure. It should be noted that other embodiments obtained by those of ordinary skill in the art based on the embodiments of this disclosure without paying creative efforts shall fall within the scope of this disclosure.

Unless otherwise specified, all the embodiments and preferred implementation methods mentioned herein can be combined with each other to form new technical solutions.

Unless otherwise specified, all the technical features and preferred features mentioned herein can be combined with each other to form a new technical solution.

In this disclosure, unless otherwise specified, percentage (%) or part refers to the weight percentage or weight part of the composition.

In this disclosure, unless otherwise specified, the involved components or the preferred components thereto can be combined with each other to form a new technical solution.

In this disclosure, unless otherwise specified, the numerical range "a-b" represents any combination of real numbers between a and b, where both a and b are real numbers. For example, the numerical range "6-22" indicates that all real numbers between "6-22" have been listed in this disclosure, and "6-22" is just a simplified representation of the combination of these numerical values.

In this disclosure, a "range" disclosed herein is in the form of a lower limit and an upper limit, and there may be one or more lower limits, and one or more upper limits, respectively.

In this disclosure, the term "and/or" used herein refers to any combinations of one or more of associated listed items and includes any combinations.

In this disclosure, unless otherwise specified, each reaction or operation step can be performed in sequence. Preferably, the reaction methods herein are performed in sequence.

Unless otherwise specified, professional and scientific terms used herein have the same meanings as those familiar to those skilled in the art. In addition, any method or material similar or equivalent to those described herein can also be used in this disclosure.

Provided herein is a biodegradable Zn—Mg—Bi zinc alloy and a preparation method thereof. A Mg-50 wt. % Bi intermediate alloy is added to a melt-down zinc melt followed by reaction under stirring under the protection of high-purity argon gas atmosphere at 640-660° C. for 20-30 min to obtain a melt. The melt is kept at 640-660° C. for 12-15 min. The melt is cast into a preheated cylindrical graphite mold at 510-550° C. to obtain a Zn—Mg—Bi biodegradable zinc alloy. The Zn—Mg—Bi biodegradable zinc alloys with different bismuth contents are provided. The structure and microstructure of zinc alloy are observed and the strengthening effect is analyzed to guide the study of the influence of bismuth on the structure and properties of zinc alloy.

The disclosure provides a biodegradable Zn—Mg—Bi zinc alloy, consisting of 1.10%-1.20% by weight of Mg, 0.50%-2.50% by weight of Bi, and Zn.

The matrix structure of the biodegradable Zn—Mg—Bi zinc alloy is a zinc dendrite, and the dual-strengthening-phase generated in the metallic zinc dendrite is a rod-shaped eutectic $Mg_2Zn_{11}$ phase, short rod-shaped $Mg_3Bi_2$ phase and granular $Mg_3Bi_2$ phase.

A grain size of the matrix structure of the biodegradable Zn—Mg—Bi zinc alloy is 15-40 μm. The rod-shaped eutectic $Mg_2Zn_{11}$ phase has a length of 3-8 μm and a thickness of 0.5-1.2 μm. The short rod-shaped $Mg_3Bi_2$ phase has a thickness of 1-1.5 μm. The granular $Mg_3Bi_2$ phase has a diameter of 1-5 μm.

The biodegradable Zn—Mg—Bi zinc alloy has a Brinell hardness of 45-77 HBS.

This disclosure provides a preparation method of the biodegradable Zn—Mg—Bi zinc alloy. The method is performed using high-purity raw materials by the high-purity smelting technology. In the raw material, the purity of the Zn is no less than 99.995%, the purity of the Mg no less than 99.999%, and the purity of the Bi no less than 99.999%. The preparation method is performed as follows.

(S1) Mg-50 wt. % Bi (mass fraction, wt. %, the same below) intermediate alloy is specifically prepared as follows.

(S101) Outer oxide films of the raw materials of (5N grade for the purity) pure magnesium ingot and (5N grade for the purity) pure bismuth particle are removed, and the raw materials and a silicon carbide crucible are preheated to 180-200° C. in a vacuum heat treatment furnace followed by drying. Considering a burning loss of the raw materials, the raw materials are weighed according to a weight ratio using an electronic balance.

The alloy density $\rho_{alloy}$ is calculated as follows:

$$\rho_{alloy}=M/V, \text{ in g/cm}^3;$$

where M is an alloy mass, and V is an alloy volume.

(S102) High-purity argon is introduced into a well-sealed pit type resistance furnace. A special covering agent used for magnesium alloy smelting is sprinkled at a bottom of the silicon carbide crucible. The magnesium ingots are put on the bottom of the silicon carbide crucible one by one using crucible tongs. And then, the covering agent is sprinkled on the magnesium ingots followed by heating to 650-700° C. for 60-90 min to completely melt the magnesium.

The melting point of pure magnesium is 648.9° C., such that the magnesium is melted at 650-700° C. for 60-90 min to obtain the magnesium melt.

(S103) Pure bismuth particles are slowly added into the magnesium melt after melting down, followed by stirring under a stirring speed of 50-80 rpm at 640-660° C. for 20-30 min, using a stirring device. After complete reacting the magnesium with bismuth, the temperature is kept at 640-660° C. in the furnace for 12-15 min to obtain a Mg—Bi alloy melt.

(S104) The Mg—Bi alloy melt is allowed to stand in the furnace for 3 to 5 min to make harmful inclusions in the melt fully floated and aggregated followed by refinement and slagging-off. The casting temperature is measured by a temperature sensor. After that, the Mg—Bi alloy melt is cast in the preheated cylindrical graphite mold, and then demolded to obtain a Mg-50 wt. % Bi alloy ingot.

(S2) The Mg-50 wt. % Bi alloy ingot prepared in step (S1) is used to prepare a biodegradable Zn—Mg—Bi zinc alloy.

(S201) The silicon carbide crucible and the raw materials are preheated to 180-200° C. followed by drying. Each raw material is weighed with the consideration of the burning loss of each raw material (Zinc is cut into small pieces followed by cleaning at the surface and drying to obtain zinc pieces. The Mg-50 wt. % Bi intermediate alloy ingot is polished at the surface, followed by cleaning and drying).

(S202) The well-sealed pit type resistance furnace is heated to 420-500° C., and the high-purity argon gas is introduced. The zinc pieces are added to the silicon carbide crucible one by one in the well-sealed pit type resistance furnace followed by keeping at 420-500° C. for 60-90 min to completely melt the zinc pieces to obtain a zinc melt. Pure magnesium and/or pure bismuth are added to the zinc melt, and then Mg-50 wt. % Bi intermediate alloy ingot is added, followed by stirring at 50-80 rpm and 640-660° C. for 20-30 min, and keeping at 640-660° C. for 12-15 min to obtain a Zn—Mg—Bi alloy melt. The Zn—Mg—Bi alloy melt includes 6-20% by volume of $Mg_3Bi_2$ as main strengthening phase, The $Mg_3Bi_2$ is produced by reaction of magnesium atoms and bismuth atoms. A weight ratio of bismuth to magnesium in the Zn—Mg—Bi alloy melt is less than or equal to 2.2.

Under the protection of the high-purity argon, the smelling process is performed in a special silicon carbide crucible, and a covering agent and refining agent are added to purify. The smelting temperature is 50° C. above the melting point to avoid overburning. The Zn—Mg—Bi biodegradable zinc alloy is cast at 510-550° C., and a forming mold is a graphite mold preheated at 180-200° C.

(S203) The Zn—Mg—Bi alloy melt are subjected to standing in the furnace for 3-5 min to make the harmful inclusions and gases in the Zn—Mg—Bi alloy melt fully floated and aggregated followed by refinement and slagging-off. After that, the Zn—Mg—Bi alloy melt is cast into the preheated cylindrical graphite at 510-550° C., and then demoulded to obtain a biodegradable Zn—Mg—Bi zinc alloy.

The biodegradable Zn—Mg—Bi zinc alloy is subjected to structural observation, structural characterization and hardness characterization.

The specific morphology of the biodegradable Zn—Mg—Bi zinc alloy and the composition of the biodegradable Zn—Mg—Bi zinc alloy are analyzed using a field emission scanning electron microscope (Zeiss, GeminiSEM 500), a supporting energy-dispersive spectrometer (EDS), an electron probe (EPMA, JEOL JXA-8230), X-ray diffraction (XRD range of 2θ is 10°-90°, current is 200 mA, voltage is 40 KV and the scanning rate is 2°/min). The hardness of the biodegradable Zn—Mg—Bi zinc alloy is tested by a Brinell hardness tester.

In order to clearly illustrate the objectives, technical solutions and advantages of this disclosure, the technical solutions of this disclosure will be clearly and completely described below with reference to the accompanying drawings in the embodiments of this disclosure. It is obvious that described below are merely some embodiments of this disclosure, which are not intended to limit the disclosure. The components described in the embodiments of this disclosure and illustrated in the accompanying drawings herein may be arranged and designed in various configurations. Thus, the following detailed description with reference to the accompanying drawings is not intended to limit the scope of this disclosure as, but is merely illustrative of selected examples of this disclosure. It should be noted that other examples obtained by those of ordinary skill in the art based on the examples of this disclosure without making creative efforts shall fall within the scope of the disclosure defined by the appended claims.

Example 1

Provided herein was a preparation of a biodegradable Zn—Mg—Bi zinc alloy, which was specifically performed through the following steps.

(S1) A magnesium ingot, a zinc ingot and a Mg-50 wt. % Bi intermediate alloy were cut into small pieces with a sawing machine, ground using a grinder, ultrasonically cleaned with alcohol and acetone and dried at 180° C. under vacuum to remove surface oxide films and oil from the sawing machine.

(S2) A Zn-1.1 wt. % Mg-0.5 wt. % Bi zinc alloy was prepared, where a weight ratio of Mg to Bi to Zn was 1.1:0.5:98.4.

(S3) The well-sealed pit type resistance furnace was heated to 420° C., and the high-purity argon gas was introduced. The zinc pieces were added to the crucible one by one and kept at 420° C. for 60 min, so as to completely melt the zinc pieces. After that, the Mg-50 wt. % Bi intermediate alloy and pure magnesium were added, fully melted, stirred at 50 rpm and 640° C. for 20 min, and then kept at 640° C. for 12 min to obtain a Zn-1.1 wt. % Mg-0.5 wt. % Bi alloy melt.

(S4) The Zn-1.1 wt. % Mg-0.5 wt. % Bi alloy melt was subjected to standing in the well-sealed pit type resistance furnace, refinement and slagging-off, and cast into a preheated mold at 510° C., and demolded to obtain a Zn-1.1 wt. % Mg-0.5 wt. % Bi zinc alloy ingot.

In Example 1, the Zn-1.1 wt. % Mg-0.5 wt. % Bi biodegradable zinc alloy was prepared by introducing the Mg—Bi intermediate alloy and pure magnesium into the zinc melt. The microstructure of the Zn-1.1 wt. % Mg-0.5 wt. % Bi biodegradable zinc alloy was analyzed and identified, and the results revealed that after the addition of 0.50 wt. % Bi, the rod-shaped $Mg_3Bi_2$ strengthening phase was precipitated in the microstructure. The formation of the rod-shaped $Mg_3Bi_2$ strengthening phase can significantly improve the alloy hardness, and the continuous addition of Bi is beneficial to the refinement of the metal zinc matrix and the strengthening phase.

Example 2

Provided herein was a preparation of a biodegradable Zn—Mg—Bi zinc alloy, which was specifically performed through the following steps.

(S1) A magnesium ingot, a zinc ingot and a Mg-50 wt. % Bi intermediate alloy were cut into small pieces with a sawing machine, ground using a grinder, ultrasonically cleaned with alcohol and acetone and dried at 190° C. under vacuum to remove surface oxide films and oil from the sawing machine.

(S2) A Zn-1.2 wt. % Mg-1.0 wt. % Bi zinc alloy was prepared, where a weight ratio of Mg to Bi to Zn was 1.2:1.0:97.8.

(S3) The well-sealed pit type resistance furnace was heated to 440° C., and the high-purity argon gas was introduced. The zinc pieces were added to the silicon carbide crucible one by one, and kept at 440° C. for 70 min, so as to completely melt the zinc pieces. After that, the Mg-50 wt. % Bi intermediate alloy and pure magnesium were added, fully melted, stirred at 55 rpm and 640° C. for 22 min, and then kept at 640° C. for 12 min to obtain a Zn-1.2 wt. % Mg-1.0 wt. % Bi zinc alloy melt.

(S4) The Zn-1.2 wt. % Mg-1.0 wt. % Bi zinc alloy melt was subjected to standing in the well-sealed pit type resistance furnace, refinement and slagging-off, and cast into a preheated mold at 520° C., and demolded to obtain a Zn-1.2 wt. % Mg-1.0 wt. % Bi zinc alloy ingot.

Example 3

Provided herein was a preparation of a biodegradable Zn—Mg—Bi zinc alloy, which was specifically performed through the following steps.

(S1) A magnesium ingot, a zinc ingot and a Mg-50 wt. % Bi intermediate alloy were cut into small pieces with a sawing machine, ground using a grinder, ultrasonically cleaned with alcohol and acetone and dried at 200° C. under vacuum to remove surface oxide films and oil from the sawing machine.

(S2) A Zn-1.2 wt. % Mg-1.5 wt. % Bi zinc alloy was prepared, where a weight ratio of Mg to Bi to Zn was 1.2:1.5:97.3.

(S3) The well-sealed pit type resistance furnace was heated to 460° C., and the high-purity argon gas was introduced. The zinc pieces were added to the silicon carbide crucible one by one, and kept at 460° C. for 75 min to completely melt the zinc pieces. After that, the Mg-50 wt. % Bi intermediate alloy and pure bismuth were added, fully melted, stirred at 60 rpm and at 650° C. for 26 min, and then kept at 650° C. for 13 min to obtain a Zn-1.2 wt. % Mg-1.5 wt. % Bi zinc alloy melt.

(S4) The Zn-1.2 wt. % Mg-1.5 wt. % Bi zinc alloy melt was subjected to standing in the well-sealed pit type resistance furnace, refinement and slagging-off, and cast into a preheated mold at 530° C., and demolded to obtain a Zn-1.2 wt. % Mg-1.5 wt. % Bi zinc alloy ingot.

Example 4

Provided herein was a preparation of a biodegradable Zn—Mg—Bi zinc alloy, which was specifically performed through the following steps.

(S1) A magnesium ingos, a zinc ingot and a Mg-50 wt. % Bi intermediate alloy were cut into small pieces with a sawing machine, ground using a grinder, ultrasonically cleaned with alcohol and acetone and dried at 180° C. under vacuum to remove surface oxide films and oil on the sawing machine.

(S2) A Zn-1.2 wt. % Mg-2.0 wt. % Bi zinc alloy was prepared, where a weight ratio of Mg to Bi to Zn was 1.2:2.0:96.8.

(S3) The well-sealed pit type resistance furnace was heated to 480° C., and the high-purity argon gas was introduced. The zinc pieces were added to the silicon carbide crucible one by one, and kept at 480° C. for 80 min to completely melt the zinc pieces. After that, the Mg-50 wt. % Bi intermediate alloy and pure bismuth were added, fully melted, stirred under at 70 rpm and 650° C. for 28 min, and then kept at 650° C. for 14 min to obtain a Zn-1.2 wt. % Mg-2.0 wt. % Bi zinc alloy melt.

(S4) The Zn-1.2 wt. % Mg-2.0 wt. % Bi zinc alloy melt was subjected to standing in the well-sealed pit type resistance furnace, refinement and slagging-off, and cast into a preheated mold at 540° C., and demolded to obtain a Zn-1.2 wt. % Mg-2.0 wt. % Bi zinc alloy ingot.

Example 5

Provided herein was a preparation of a biodegradable Zn—Mg—Bi zinc alloy, which was specifically performed through the following steps.

(S1) A magnesium ingot, a zinc ingot and a Mg-50 wt. % Bi intermediate alloy were cut into small pieces with a sawing machine, ground using a grinder, ultrasonically cleaned with alcohol and acetone and dried at 200° C. under vacuum to remove surface oxide films and oil on the sawing machine.

(S2) A Zn-1.2 wt. % Mg-2.5 wt. % Bi zinc alloy was prepared, where a weight ratio of Mg to Bi to Zn was 1.2:2.5:96.3.

(S3) The well-sealed pit type resistance furnace was heated to 500° C., and the high-purity argon gas was introduced. The zinc pieces were added to the silicon carbide crucible one by one, and kept at 500° C. for 90 min to completely melt the zinc pieces. After that, the Mg-50 wt. % Bi intermediate alloy and pure bismuth were added, fully melted, stirred at 80 rpm and 660° C. for 30 min, and then kept at 660° C. for 15 min to obtain a Zn-1.2 wt. % Mg-2.5 wt. % Bi zinc alloy melt.

(S4) The Zn-1.2 wt. % Mg-2.5 wt. % Bi zinc alloy melt was subjected to standing in the well-sealed pit type resistance furnace, refinement and slagging-off, and cast into a preheated mold at 550° C., and demolded to obtain a Zn-1.2 wt. % Mg-2.5 wt. % Bi zinc alloy ingot.

Referring to an embodiment shown in FIG. 1, a metallographic microstructure of the Mg-50 wt. % Bi alloy is composed of α-Mg dendrite structure and α-Mg+$Mg_3Bi_2$ eutectic structure.

Figure 2:
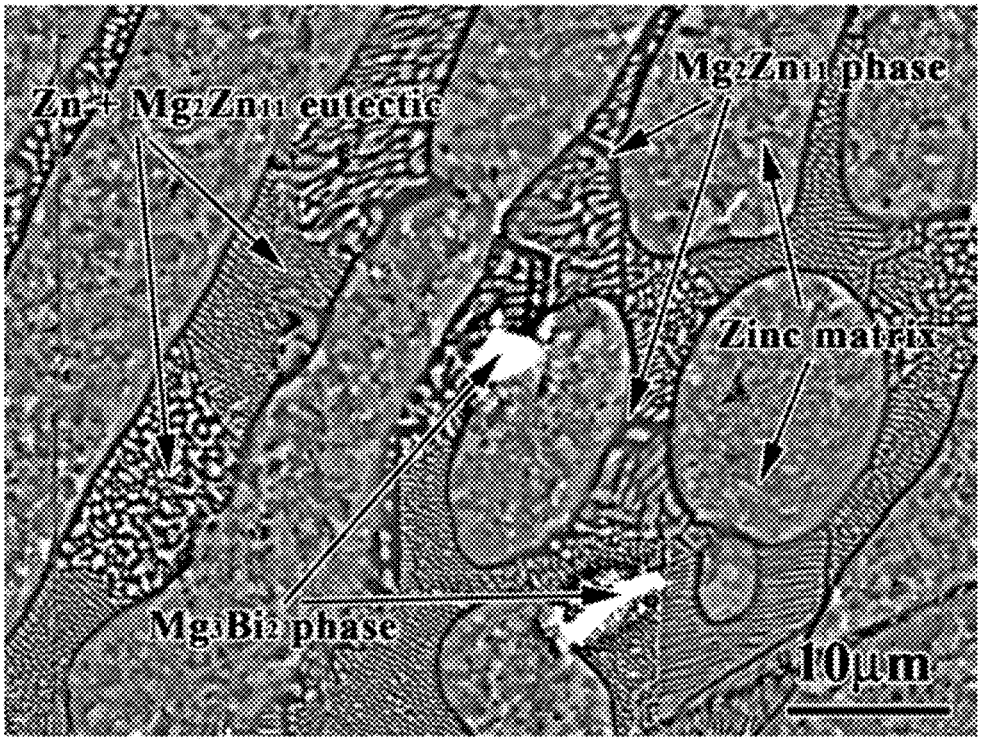
FIG. 2 depicts a microstructure of a biodegradable Zn-1.2 wt. % Mg-0.5 wt. % Bi zinc alloy.

Referring to an embodiment shown in FIG. 2, a metallographic microstructure of the Zn-1.2 wt. % Mg-0.5 wt. % Bi biodegradable zinc alloy is composed of Zn matrix, α-Zn+$Mg_2Zn_{11}$ eutectic structure, rod-shaped $Mg_2Zn_{11}$ eutectic phase, and granular $Mg_3Bi_2$ phase.

With regard to the method provided herein, the Mg—Bi intermediate alloy is added to introduce the bismuth element into the zinc alloy under the protection of high-purity argon gas and a covering agent, so as to obtain the bismuth-containing biodegradable zinc alloy, which was rarely studied. According to the microstructure of biodegradable Zn—Mg—Bi zinc alloy, it can be found out that the mechanical properties of the alloy are improved by strengthening in two direction of grain boundary and the intragrain.

It should be noted that the above embodiments are merely illustrative of the technical solutions of this disclosure, but not intended to limit this disclosure. Although this disclosure has been described in detail with reference to the above-mentioned examples, it should be understood that those skilled in the art can still make some modifications, and replacements to the technical features described in the above-mentioned examples. Those modifications or replacements made without departing from the spirit of the disclosure shall fall within the scope of the disclosure defined by the appended claims.

What is claimed is:

1. A method for preparing a biodegradable Zn—Mg—Bi zinc alloy, comprising:

(1) melting magnesium under an inert atmosphere to obtain a magnesium melt; adding bismuth particles to the magnesium melt followed by reaction under stirring and heat preservation treatment to obtain a Mg—Bi alloy melt; allowing the Mg—Bi alloy melt to stand in a furnace; and subjecting the Mg—Bi alloy melt to refining, slagging-off, casting and demoulding to obtain a Mg-50 wt. % Bi alloy ingot; and (2) melting zinc to obtain a zinc melt; adding the Mg-50 wt. % Bi alloy ingot and pure magnesium or pure bismuth to the zinc melt, followed by heating under stirring, and heat preservation to obtain a Zn—Mg—Bi alloy melt; allowing the Zn—Mg—Bi alloy melt to stand in the furnace; and subjecting the Zn—Mg—Bi alloy melt to refining, slagging-off, casting and demoulding to obtain the biodegradable Zn—Mg—Bi zinc alloy.

2. The method of claim 1, wherein the Mg—Bi alloy melt is prepared through steps of:

melting the magnesium at 650-700° C. in argon gas in the presence of a covering agent followed by keeping at 650-700° C. for 60-90 min to obtain the magnesium melt; and adding the bismuth particles to the magnesium melt followed by reaction under stirring at 50-80 rpm and 640-660° C. for 20-30 min and keeping at 640-660° C. for 12-15 min to obtain the Mg—Bi alloy melt.

3. The method of claim 1, wherein in step (1), the casting is performed at 580-610° C.; and the Mg—Bi alloy melt is allowed to stand in the furnace for 3-5 min.

4. The method of claim 1, wherein the Zn—Mg—Bi alloy melt is prepared through steps of:

melting the zinc at 420-500° C. in argon gas for 60-90 min to obtain the zinc melt; adding the Mg-50 wt. % Bi alloy ingot and pure magnesium or pure bismuth to the zinc melt followed by stirring at 50-80 rpm and 640-660° C. for 20-30 min and keeping at 640-660° C. for 12-15 min to obtain the Zn—Mg—Bi alloy melt.

5. The method of claim 4, wherein the Zn—Mg—Bi alloy melt comprises 6-20% by volume of $Mg_3Bi_2$ as main strengthening phase; the $Mg_3Bi_2$ is produced by reaction of magnesium atoms and bismuth atoms; and a weight ratio of bismuth to magnesium in the Zn—Mg—Bi alloy melt is less than or equal to 2.2.

6. The method of claim 1, wherein in step (2), the casting is performed at 510-550° C., and a mold used in the demoulding is preheated to 180-200° C.

* * * * *